US011469063B2

(12) United States Patent
Nishida et al.

(10) Patent No.: US 11,469,063 B2
(45) Date of Patent: Oct. 11, 2022

(54) CONTACT DEVICE

(71) Applicant: OMRON Corporation, Kyoto (JP)

(72) Inventors: Takeshi Nishida, Ibaraki (JP); Tatsuro Kato, Otsu (JP)

(73) Assignee: OMRON CORPORATION, Kyoto (JP)

( * ) Notice: Subject to any disclaimer, the term of this patent is extended or adjusted under 35 U.S.C. 154(b) by 0 days.

(21) Appl. No.: 17/287,516

(22) PCT Filed: Oct. 16, 2019

(86) PCT No.: PCT/JP2019/040549
§ 371 (c)(1),
(2) Date: Apr. 22, 2021

(87) PCT Pub. No.: WO2020/100496
PCT Pub. Date: May 22, 2020

(65) Prior Publication Data

US 2021/0398761 A1 Dec. 23, 2021

(30) Foreign Application Priority Data

Nov. 16, 2018 (JP) ..... JP2018-215492

(51) Int. Cl.
*H01H 33/42* (2006.01)
*H01H 33/70* (2006.01)

(52) U.S. Cl.
CPC ..... *H01H 33/70* (2013.01); *H01H 33/42* (2013.01)

(58) Field of Classification Search
CPC .... H01H 33/42; H01H 33/70; H01H 33/7069; H01H 33/76; H01H 33/765; H01H 9/302;
(Continued)

(56) References Cited

U.S. PATENT DOCUMENTS 4,743,720 A 5/1988 Takeuchi et al.
6,075,429 A * 6/2000 Uotome ..... H01H 9/443 335/130

(Continued)

FOREIGN PATENT DOCUMENTS

JP 63-102119 A 5/1988
JP 4-124727 U 11/1992

(Continued)

OTHER PUBLICATIONS

Translation of JP2015049938(Original doc. published Mar. 16, 2015) (Year: 2015).*

(Continued)

*Primary Examiner* — William A Bolton
(74) *Attorney, Agent, or Firm* — Shinjyu Global IP

(57) ABSTRACT

A contact device includes a fixed contact, a movable contact, a housing, and an arc extinguishing member. The movable contact moves between a closed position where the movable contact contacts the fixed contact and an open position where the movable contact is separate from fixed contact. The housing houses the fixed contact and the movable contact. The arc extinguishing member is disposed in the housing and discharges an arc extinguishing gas. The arc extinguishing member is disposed facing a gap between the fixed contact and the movable contact when the movable contact is in the open position. The arc extinguishing member has a shape that tapers toward the gap.

9 Claims, 10 Drawing Sheets

(58) Field of Classification Search
CPC ..... H01H 9/32; H01H 1/66; H01H 50/38; H01H 50/54; H01H 50/546; H01H 71/0235; H01H 50/00
USPC ..... 218/43, 51, 46, 55, 59, 67, 68, 90
See application file for complete search history.

(56) References Cited

U.S. PATENT DOCUMENTS

| | | | | |
|---|---|---|---|---|
| 7,023,306 | B2 * | 4/2006 | Nishida | H01H 50/305 335/128 |
| 9,059,523 | B2 * | 6/2015 | Enomoto | H01H 1/54 |
| 2013/0240495 | A1 * | 9/2013 | Yano | H01H 9/36 219/123 |
| 2016/0233039 | A1 | 8/2016 | Kanematsu et al. | |
| 2019/0066951 | A1 | 2/2019 | Kanematsu et al. | |

FOREIGN PATENT DOCUMENTS

| | | |
|---|---|---|
| JP | 2015-49938 A | 3/2015 |
| JP | 2015-49939 A | 3/2015 |

OTHER PUBLICATIONS

Translation of JP63102119(original doc. published May 7, 1988) (Year: 1988).*
Translation of JPH04124727(Original doc. published Nov. 13, 1992) (Year: 1992).*
International Search Report of International Application No. PCT/JP2019/040549 dated Dec. 3, 2019.
Written Opinion of the International Searching Authority of International Application No. PCT/JP2019/040549 dated Dec. 3, 2019.

* cited by examiner

CONTACT DEVICE

CROSS-REFERENCE TO RELATED APPLICATION

This application is the U.S. National Phase of International Application No. PCT/JP2019/040549, filed on Oct. 16, 2019. This application claims priority to Japanese Patent Application No. 2018-215492, filed Nov. 16, 2018. The contents of those applications are incorporated by reference herein in their entireties.

FIELD

The present invention relates to a contact device.

BACKGROUND

A contact device includes a fixed contact and a movable contact. The movable contact moves between a closed position where the movable contact contacts the fixed contact and an open position where the movable contact is separate from the fixed contact. When the movable contact separates from the fixed contact, an arc is generated between the contacts. Conventionally, as described in Japanese Laid-Open Patent Publication No. 2015-49939, there is known a contact device including an arc extinguishing member disposed in a space where the contacts are housed in order to quickly extinguish an arc. The arc extinguishing member discharges an arc extinguishing gas by utilizing heat of the arc. The arc extinguishing gas extinguishes the arc, thereby improving breakdown performance of the contact device.

SUMMARY

In order to improve arc extinguishing performance owing to the arc extinguishing gas, it is desirable that the arc extinguishing member is disposed proximate to a gap between the fixed contact and the movable contact. However, if the arc extinguishing member is disposed proximate to the gap between the contacts, a space between the arc extinguishing member and the contacts becomes narrow. Thus, the arc is less likely to pass through the space and stays. This makes it difficult for the arc to be extinguished quickly.

An object of the present invention is to improve the arc extinguishing performance owing to the arc extinguishing gas.

A contact device according to one aspect of the present invention includes a fixed contact, a movable contact, a housing, and an arc extinguishing member. The movable contact moves between a closed position where the movable contact contacts the fixed contact and an open position where the movable contact is separate from the fixed contact. The housing houses the fixed contact and the movable contact. The arc extinguishing member is disposed in the housing and discharges an arc extinguishing gas. The arc extinguishing member is disposed facing a gap between the fixed contact and the movable contact when the movable contact is in the open position. The arc extinguishing member has a shape that tapers toward the gap.

In the contact device according to the present aspect, the arc extinguishing member has a shape that tapers toward the gap between the contacts. Therefore, even if the arc extinguishing member is disposed proximate to the gap, a large space can be secured between the contacts and the arc extinguishing member. Accordingly, an arc extinguishing gas can be generated proximate to the gap between the contacts and an arc can easily pass through a space between the contacts and the arc extinguishing member. As a result, the arc is easily extended and quickly extinguished. Further, the arc is divided by the arc extinguishing member and extended along the arc extinguishing member, whereby the arc can be extinguished more quickly. Thus, the arc extinguishing performance owing to the arc extinguishing gas can be improved.

The arc extinguishing member may include a tip portion, a base portion, and a tapered portion. The tip portion may face the gap. The base portion may have a larger outer shape than the tip portion. The tapered portion is provided between the tip portion and the base portion and may have a shape that tapers from the base portion toward the tip portion. In this case, the tip portion has a smaller outer shape than the base portion. Therefore, a large space can be secured between the contacts and the tip portion as compared with a case where the tip portion has an outer shape as large as the base portion.

A direction from the movable contact toward the fixed contact is defined as an upper direction and an opposite direction thereto is defined as a lower direction, and an upper end of the base portion may be positioned above a lower end of the fixed contact. In this case, an arc contacts the arc extinguishing member quickly. Therefore, the arc extinguishing gas can be generated quickly. Thus, the arc extinguishing performance can be improved. An upper end of the tip portion may be positioned below the upper end of the base portion. In this case, a large space can be secured between the fixed contact and the tip portion.

A lower end of the base portion may be positioned below an upper end of the movable contact. In this case, the arc contacts the arc extinguishing member quickly. Therefore, the arc extinguishing gas can be generated quickly. Thus, the arc extinguishing performance can be improved. A lower end of the tip portion may be positioned above the lower end of the base portion. In this case, a large space can be secured between the movable contact and the tip portion.

The fixed contact may include a contact surface and a corner portion. The contact surface may contact the movable contact when the movable contact is in the closed position. The corner portion may be positioned above the contact surface and connected to the contact surface. The corner portion may have a curved shape or a chamfered shape. The upper end of the tip portion may be positioned below an upper end of the corner portion. In this case, a large space can be secured between the fixed contact and the tip portion.

The tip portion may be positioned between the upper end of the corner portion and the upper end of the movable contact in the upper and lower direction. In this case, a large space can be secured between the fixed contact and the tip portion.

In a direction from the arc extinguishing member toward the gap, a distance between a tip of the arc extinguishing member and the fixed contact may be smaller than a distance from the housing to the tip of the arc extinguishing member. In this case, the tip of the arc extinguishing member can be disposed proximate to the fixed contact. Thus, the arc extinguishing performance can be improved.

In the direction from the arc extinguishing member toward the gap, a distance between the tip of the arc extinguishing member and the movable contact may be smaller than the distance from the housing to the tip of the arc extinguishing member. In this case, the tip of the arc extinguishing member can be disposed proximate to the movable contact. Thus, the arc extinguishing performance can be improved.

DETAILED DESCRIPTION

Figure 1:
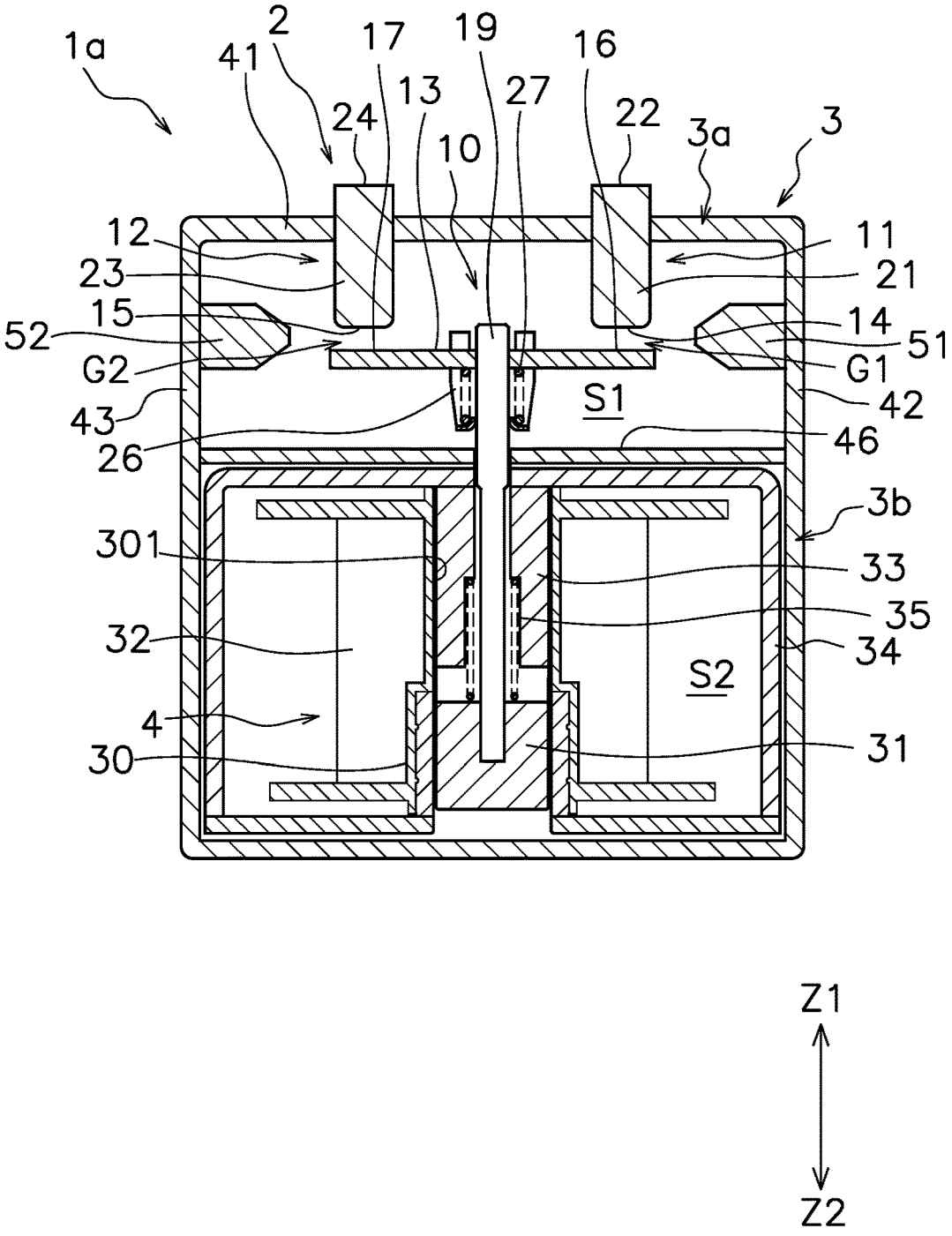
FIG. 1 is a side sectional view of a relay in an open state according to an embodiment.

Hereinafter, a relay 1*a* according to an embodiment will be described with reference to the drawings. FIG. 1 is a side sectional view of the relay 1*a* according to the embodiment. As illustrated in FIG. 1, the relay 1*a* includes a contact device 2, a housing 3, and a drive device 4. In the following description, the up, down, left, and right directions indicate the up, down, left, and, right directions in FIG. 1. Specifically, a direction from the drive device 4 toward the contact device 2 is defined as an upper direction. A direction from the contact device 2 toward the drive device 4 is defined as a lower direction. In FIG. 1, a direction that intersects an upper and lower direction is defined as a left-right direction. A direction that intersects the upper and lower direction and the left-right direction is defined as a front-back direction. The front-back direction is a direction perpendicular to the sheet of FIG. 1. However, these directions are defined for convenience of description and are not intended to limit the directions in which the relay 1*a* is disposed.

The contact device 2 includes a movable mechanism 10, a first fixed terminal 11, a second fixed terminal 12, a movable contact piece 13, a first movable contact 16, and a second movable contact 17. The first fixed terminal 11 and the second fixed terminal 12 are made from a conductive material such as copper, for example. The first fixed terminal 11 is provided with a first fixed contact 14. The second fixed terminal 12 is provided with a second fixed contact 15. The first fixed contact 14 and the second fixed contact 15 are disposed apart from each other in the left-right direction.

The first fixed terminal 11 includes a first contact support portion 21 and a first external terminal portion 22. The first fixed contact 14 is connected to the first contact support portion 21. The first external terminal portion 22 is connected to the first contact support portion 21. The first external terminal portion 22 protrudes outward from the housing 3. The second fixed terminal 12 includes a second contact support portion 23 and a second external terminal portion 24. The second fixed contact 15 is connected to the second contact support portion 23. The second external terminal portion 24 is connected to the second contact support portion 23. The second external terminal portion 24 protrudes outward from the housing 3.

In FIG. 1, the first external terminal portion 22 and the second external terminal portion 24 protrude toward the upper direction from the housing 3. However, the direction toward which the first external terminal portion 22 and the second external terminal portion 24 protrude is not limited to the upper and lower direction. The first external terminal portion 22 and the second external terminal portion 24 may protrude from the housing 3 toward any direction such as the left-right direction, the front-back direction, or the like.

The movable contact piece 13 is made from a conductive material such as copper, for example. The movable contact piece 13 extends in the left-right direction. In the present embodiment, the longitudinal direction of the movable contact piece 13 coincides with the left-right direction. The movable contact piece 13 is disposed facing the first fixed terminal 11 and the second fixed terminal 12 in the upper and lower direction.

The movable contact piece 13 is disposed such as to be movable in a contact direction Z1 and a separation direction Z2. The contact direction Z1 is a direction in which the movable contact piece 13 approaches the first fixed terminal 11 and the second fixed terminal 12 (the upper direction in FIG. 1). The separation direction Z2 is a direction in which the movable contact piece 13 separates from the first fixed terminal 11 and the second fixed terminal 12 (the lower direction in FIG. 1).

The first movable contact 16 and the second movable contact 17 are supported by the movable contact piece 13. The first movable contact 16 and the second movable contact 17 are disposed apart from each other in the left-right direction. The first movable contact 16 faces the first fixed contact 14 in the upper and lower direction. The second movable contact 17 faces the second fixed contact 15 in the upper and lower direction.

The movable mechanism 10 is disposed such as to be movable in the contact direction Z1 and the separation direction Z2 together with the movable contact piece 13. The movable mechanism 10 includes a drive shaft 19, a holder 26, and a contact spring 27. The drive shaft 19 extends in the upper and lower direction. The drive shaft 19 is connected to the movable contact piece 13. The drive shaft 19 extends toward the lower direction from the movable contact piece 13. The drive shaft 19 is connected to the movable contact piece 13 via the holder 26 and the contact spring 27. The holder 26 is attached to the movable contact piece 13 and holds the movable contact piece 13. The contact spring 27 is disposed between the holder 26 and the movable contact piece 13. The contact spring 27 urges the movable contact piece 13 toward the contact direction Z1 in a state where the movable contacts 16 and 17 contact the fixed contacts 14 and 15.

The housing 3 houses the contact device 2 and the drive device 4. The housing 3 includes a first housing 3*a* and a second housing 3*b*. The first housing 3*a* includes a first storage portion S1. The second housing 3*b* includes a second storage portion S2. The first storage portion S1 and the second storage portion S2 are partitioned by a partition wall 46. The fixed contacts 14 and 15, the movable contact piece 13, and the movable contacts 16 and 17 are disposed in the first storage portion S1. The drive device 4 is disposed in the second storage portion S2.

The first housing 3*a* includes a top surface 41, a first side surface 42, and a second side surface 43. The top surface 41 faces the movable contact piece 13 in a moving direction of the movable mechanism 10. The top surface 41 is disposed above the movable contact piece 13. The first side surface 42 and the second side surface 43 are disposed spaced apart from each other in the left-right direction. The first side surface 42 and the second side surface 43 face the movable contact piece 13 in a direction that intersects the moving direction of the movable mechanism 10. That is, the first side surface 42 and the second side surface 43 face the movable contact piece 13 in the left-right direction. The first side surface 42 and the second side surface 43 extend in the moving direction of the movable mechanism 10. The movable contact piece 13 is disposed between the first side surface 42 and the second side surface 43 in the left-right direction.

The drive device 4 operates the movable contact piece 13 by electromagnetic force. The drive device 4 moves the movable contact piece 13 in the contact direction Z1 and the separation direction Z2. The drive device 4 is disposed below the housing 3. The drive device 4 includes a spool 30, a movable iron core 31, a coil 32, a fixed iron core 33, a yoke 34, and a return spring 35.

The spool 30 includes a hole 301 that penetrates the spool 30 in the upper and lower direction. The movable iron core 31 is disposed in the hole 301 of the spool 30. The movable iron core 31 is provided separately from the fixed iron core 33. The movable iron core 31 is connected to the drive shaft 19. The movable iron core 31 is configured to move in the contact direction Z1 and the separation direction Z2. The coil 32 is wound around the spool 30. The coil 32 is energized to generate electromagnetic force that moves the movable iron core 31 toward the contact direction Z1.

The fixed iron core 33 is disposed in the hole 301 of the spool 30. The fixed iron core 33 is disposed facing the movable iron core 31. The return spring 35 is disposed between the movable iron core 31 and the fixed iron core 33. The return spring 35 urges the movable iron core 31 toward the separation direction Z2.

The yoke 34 is disposed such as to surround the coil 32. The yoke 34 is disposed on a magnetic circuit formed by the coil 32. Portions of the yoke 34 are disposed above the coil 32, to the sides of the coil 32, and below the coil 32.

Next, an operation of the relay 1*a* will be described. When the coil 32 is not energized, the drive device 4 is not magnetized. In this case, the drive shaft 19 is pressed toward the separation direction Z2 together with the movable iron core 31 by elastic force of the return spring 35. Therefore, the movable contact piece 13 is also pressed toward the separation direction Z2, and the movable contacts 16 and 17 are in their open positions illustrated in FIG. 1. In the state where the movable contacts 16 and 17 are in the open positions, the first movable contact 16 and the second movable contact 17 are separate from the first fixed contact 14 and the second fixed contact 15.

Figure 2:
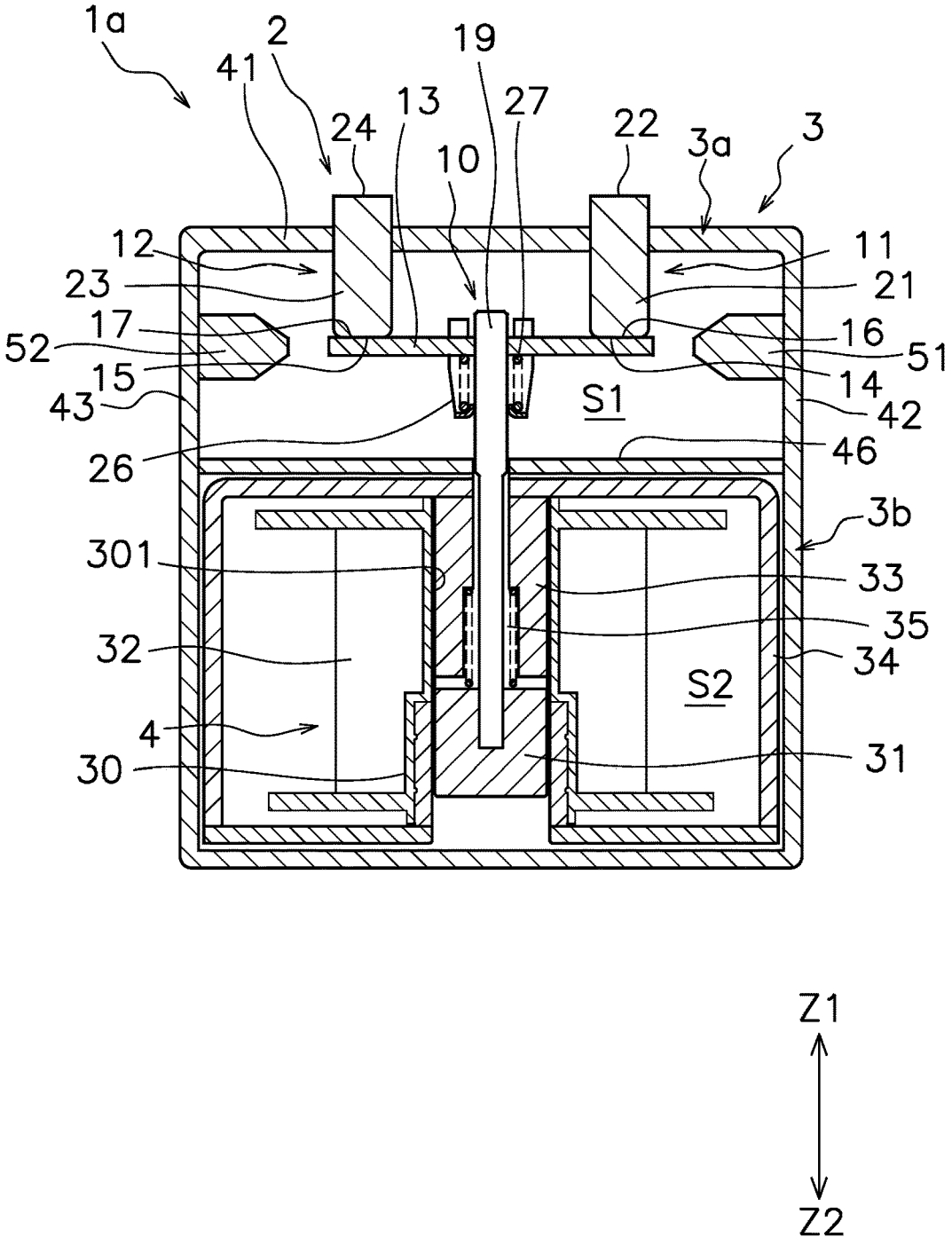
FIG. 2 is a side sectional view of the relay in a closed state.

When the coil 32 is energized, the drive device 4 is magnetized. In this case, electromagnetic force of the coil 32 causes the movable iron core 31 to move toward the contact direction Z1 against the elastic force of the return spring 35. As a result, both the drive shaft 19 and the movable contact piece 13 move toward the contact direction Z1, and the movable contacts 16 and 17 move to their closed positions illustrated in FIG. 2. In the state where the movable contacts 16 and 17 are in the closed positions, the first movable contact 16 and the second movable contact 17 contact the first fixed contact 14 and the second fixed contact 15, respectively.

When a current to the coil 32 is stopped and the coil is demagnetized, the movable iron core 31 is pressed toward the separation direction Z2 by the elastic force of the return spring 35. As a result, both the drive shaft 19 and the movable contact piece 13 move toward the separation direction Z2, and the movable contacts 16 and 17 return to the open positions illustrated in FIG. 1.

As illustrated in FIG. 1, the contact device 2 includes a first arc extinguishing member 51 and a second arc extinguishing member 52. The first arc extinguishing member 51 and the second arc extinguishing member 52 are disposed in the first storage portion S1. The first and second arc extinguishing members 51 and 52 are made from a material that discharges an arc extinguishing gas by utilizing heat of an arc. The arc extinguishing gas is, for example, a gas containing hydrogen or nitrogen as a main component, and can extinguish an arc. Alternatively, the arc extinguishing gas is not limited to the gas mainly containing hydrogen or nitrogen, and may be a gas containing another element as a main component.

The first and second arc extinguishing members 51 and 52 may be formed of a material such as a phenol resin, a hydrogen storage metal, or a titanium hydride. Alternatively, the first and second arc extinguishing members 51 and 52 may be formed of, for example, a thermosetting resin such as an unsaturated polyester resin or a melamine resin. Alternatively, the first and second arc extinguishing members 51 and 52 may be formed of a thermoplastic resin such as a polyolefin resin, a polyamide resin, or a polyacetal resin. Alternatively, the first and second arc extinguishing members 51 and 52 may be formed of another material.

The first arc extinguishing member 51 is disposed facing a gap G1 (hereinafter referred to as a "first gap G1") between the first fixed contact 14 and the first movable contact 16 when the movable contacts 16 and 17 are in the open positions. The first arc extinguishing member 51 has a shape that tapers toward the first gap G1. The second arc extinguishing member 52 faces a gap G2 (hereinafter referred to as a "second gap G2") between the second fixed contact 15 and the second movable contact 17 when the movable contacts 16 and 17 are in the open positions. The second arc extinguishing member 52 has a shape that tapers toward the second gap G2.

The first and second arc extinguishing members 51 and 52 are connected to the first housing 3*a*. Specifically, the first arc extinguishing member 51 is connected to the first side surface 42. The second arc extinguishing member 52 is connected to the second side surface 43. The first arc extinguishing member 51 protrudes from the first side surface 42 toward the first gap G1. The second arc extinguishing member 52 protrudes from the second side surface 43 toward the second gap G2.

Figure 3:
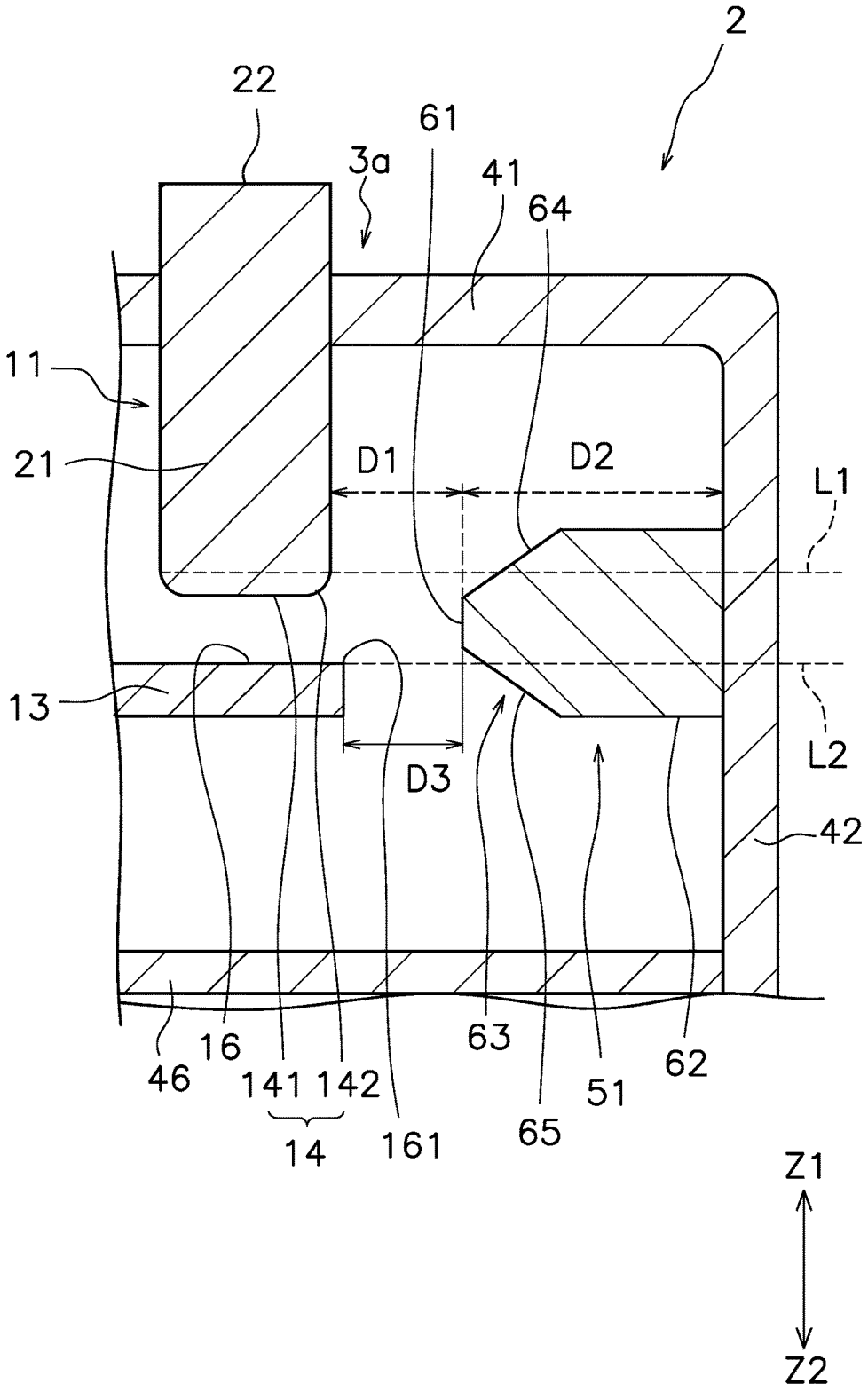
FIG. 3 is an enlarged view illustrating a first fixed contact, a first movable contact, and a first arc extinguishing member.
Figure 4:
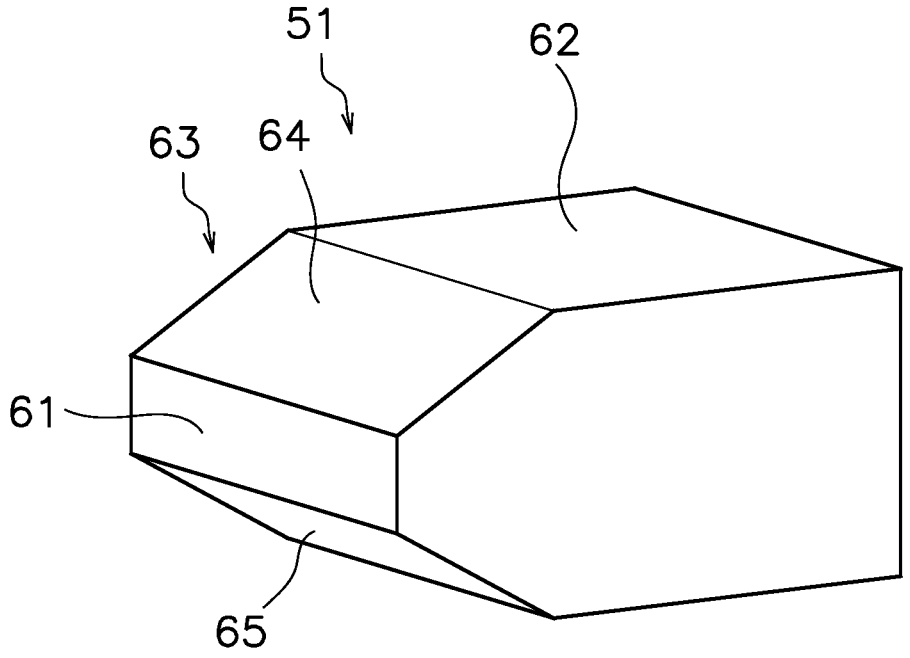
FIG. 4 is a perspective view of the first arc extinguishing member.

FIG. 3 is an enlarged view illustrating the first fixed contact 14, the first movable contact 16, and the first arc extinguishing member 51. FIG. 4 is a perspective view of the first arc extinguishing member 51. As illustrated in FIGS. 3 and 4, the first arc extinguishing member 51 has a trapezoidal shape. Specifically, the first arc extinguishing member 51 includes a tip portion 61, a base portion 62, and a tapered portion 63. The tip portion 61 faces the first gap G1. The tip portion 61 has a flat shape. However, the tip portion 61 may have a curved shape. The tapered portion 63 is provided between the tip portion 61 and the base portion 62. The tapered portion 63 has a shape that tapers from the base portion 62 toward the tip portion 61.

The base portion 62 has a larger outer shape than the tip portion 61. Specifically, the base portion 62 has a larger area than the tip portion 61 when viewed from a direction in which the first arc extinguishing member 51 faces the first gap G1. In other words, the tip portion 61 has a smaller area than the base portion 62 when viewed from the direction in which the first arc extinguishing member 51 faces the first gap G1. The dimension of the base portion 62 in the upper and lower direction is larger than the dimension of the tip portion 61 in the upper and lower direction. In other words, the dimension of the tip portion 61 in the upper and lower direction is smaller than the dimension of the base portion 62 in the upper and lower direction.

As illustrated in FIG. 3, a lower end of the base portion 62 is positioned below an upper end of the first movable contact 16. An upper end of the base portion 62 is positioned above a lower end of the first fixed contact 14. A lower end of the tip portion 61 is positioned above the lower end of the base portion 62. An upper end of the tip portion 61 is positioned below the upper end of the base portion 62.

The first fixed contact 14 includes a contact surface 141 and a corner portion 142. The contact surface 141 contacts the first movable contact 16 when the first movable contact 16 is in the closed position. The corner portion 142 is positioned above the contact surface 141 and is connected to the contact surface 141. The corner portion 142 has a curved shape. However, the corner portion 142 may have a chamfered shape.

In FIG. 3, a dashed line L1 indicates a position of an upper end of the corner portion 142. A dashed line L2 indicates a position of the upper end of the first movable contact 16. As illustrated in FIG. 3, at least a part of the tip portion 61 is positioned between the upper end of the corner portion 142 (L1) and the upper end of the first movable contact 16 (L2). Preferably, the entire tip portion 61 is positioned between the upper end of the corner portion 142 (L1) and the upper end of the first movable contact 16 (L2). The upper end of the tip portion 61 is positioned below the upper end of the corner portion 142 (L1).

The first arc extinguishing member 51 is disposed proximate to the first gap G1. Specifically, in a direction from the first arc extinguishing member 51 toward the first gap G1, a distance D1 between a tip of the first arc extinguishing member 51 and the first fixed contact 14 is smaller than a distance D2 from the first housing 3*a* (the first side surface 42) to the tip of the first arc extinguishing member 51. In the direction from the first arc extinguishing member 51 toward the first gap G1, a distance D3 between the tip of the first arc extinguishing member 51 and the first movable contact 16 is smaller than the distance D2 from the first housing 3*a* (the first side surface 42) to the tip of the first arc extinguishing member 51.

The tapered portion 63 includes a first tapered surface 64 and a second tapered surface 65. The first tapered surface 64 and the second tapered surface 65 are inclined such that a distance between the first tapered surface 64 and the second tapered surface 65 decreases toward the first gap G1. The first tapered surface 64 faces the corner portion 142 of the first fixed contact 14. The second tapered surface 65 faces the corner portion 161 of the first movable contact 16.

Figure 5:
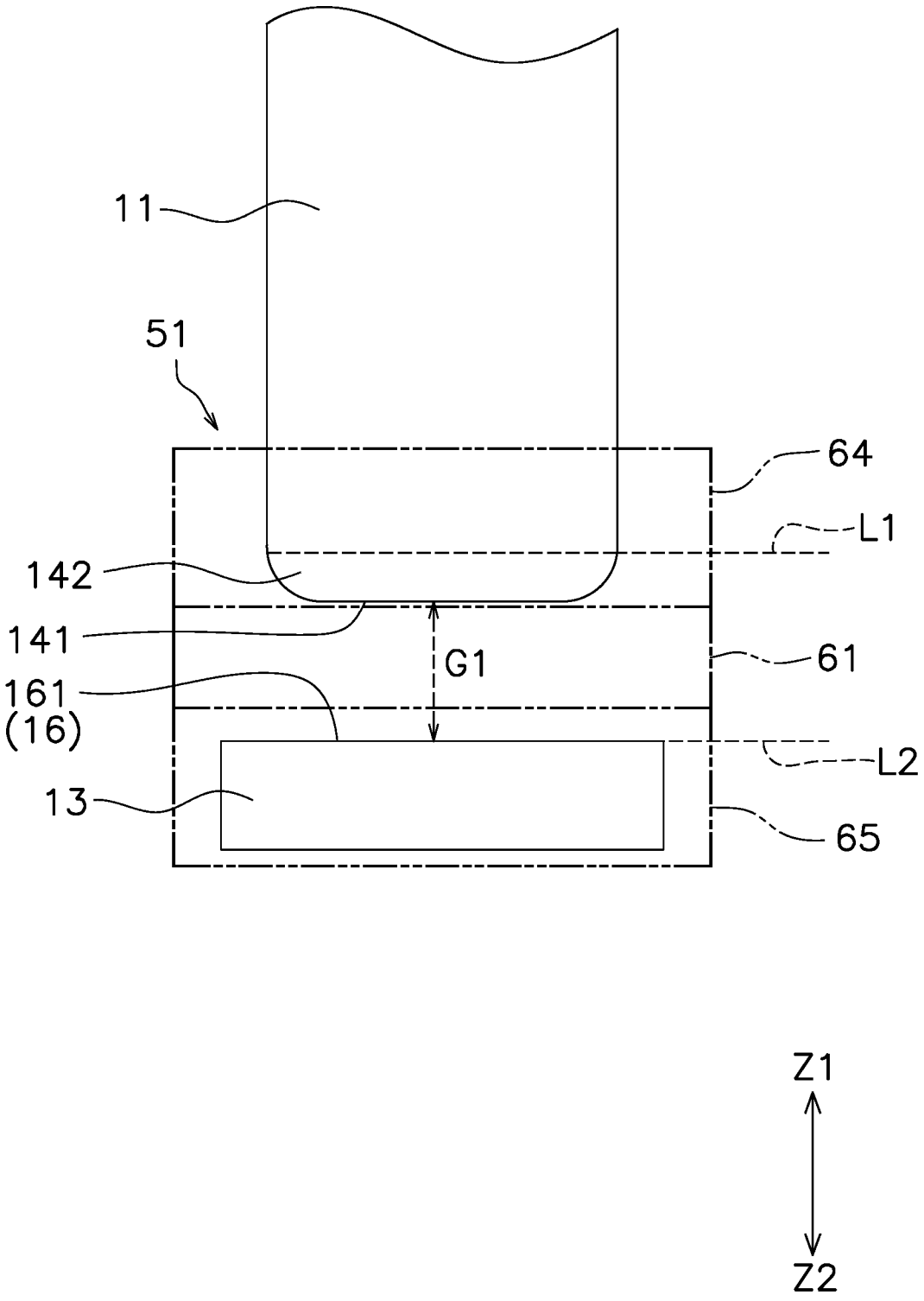
FIG. 5 is a view illustrating the first fixed contact, the first movable contact, and the first arc extinguishing member when viewed from a direction in which the first arc extinguishing member faces a first gap.

FIG. 5 is a view illustrating the first fixed contact 14, the first movable contact 16, and the first arc extinguishing member 51 when viewed from the left-right direction. In other words, FIG. 5 is the view illustrating the first fixed contact 14, the first movable contact 16, and the first arc extinguishing member 51 when viewed from the direction in which the first arc extinguishing member 51 faces the first gap G1. As illustrated in FIG. 5, the first tapered surface 64 overlaps the corner portion 142 of the first fixed contact 14 when viewed from the direction in which the first arc extinguishing member 51 faces the first gap G1. The second tapered surface 65 overlaps the corner portion 161 of the first movable contact 16 when viewed from the direction in which the first arc extinguishing member 51 faces the first gap G1.

The second arc extinguishing member 52 has a same structure as that of the first arc extinguishing member 51 except that the second arc extinguishing member 52 is provided substantially left-right symmetrically with respect to the first arc extinguishing member 51. Therefore, detailed description of the second arc extinguishing member 52 is omitted.

In the contact device 2 according to the present embodiment described above, the first arc extinguishing member 51 has a shape that tapers toward the first gap G1. Therefore, even if the first arc extinguishing member 51 is disposed proximate to the first gap G1, a large space can be secured between the first fixed contact 14 and the first arc extinguishing member 51. Further, a large space can be secured between the first movable contact 16 and the first arc extinguishing member 51. Accordingly, an arc extinguishing gas can be generated proximate to the first gap G1 and an arc can easily pass through a space between the first fixed contact 14 and the first arc extinguishing member 51 and a space between the first movable contact 16 and the first arc extinguishing member 51. As a result, the arc is easily extended and quickly extinguished.

The arc is divided by the first arc extinguishing member 51 and extended along the first arc extinguishing member 51, whereby the arc can be extinguished more quickly. Thus, the arc extinguishing performance owing to the arc extinguishing gas can be improved. The second arc extinguishing member 52 achieves the same effect as that of the first arc extinguishing member 51 as described above.

Although an embodiment of the present invention has been described so far, the present invention is not limited to the above embodiment and various modifications may be made within the scope of the invention. For example, the contact device may be used for a breaker, a switch, or the like, instead of a relay.

In the above embodiment, the drive device 4 pushes out the drive shaft 19 from the drive device 4 side so that the movable contact piece 13 moves toward the contact direction Z1. Also, the drive device 4 pulls in the drive shaft 19 toward the drive device 4 side so that the movable contact piece 13 moves toward the separation direction Z2. However, the operation direction of the drive shaft 19 for opening and closing the contacts may be opposite to that in the above embodiment. That is, the drive device 4 may pull in the drive shaft 19 toward the drive device 4 side so that the movable contact piece 13 moves toward the contact direction Z1. The drive device 4 may push out the drive shaft 19 from the drive device 4 side so that the movable contact piece 13 moves toward the separation direction Z2. That is, the contact direction Z1 and the separation direction Z2 may be opposite to those in the above embodiment.

Figure 6:
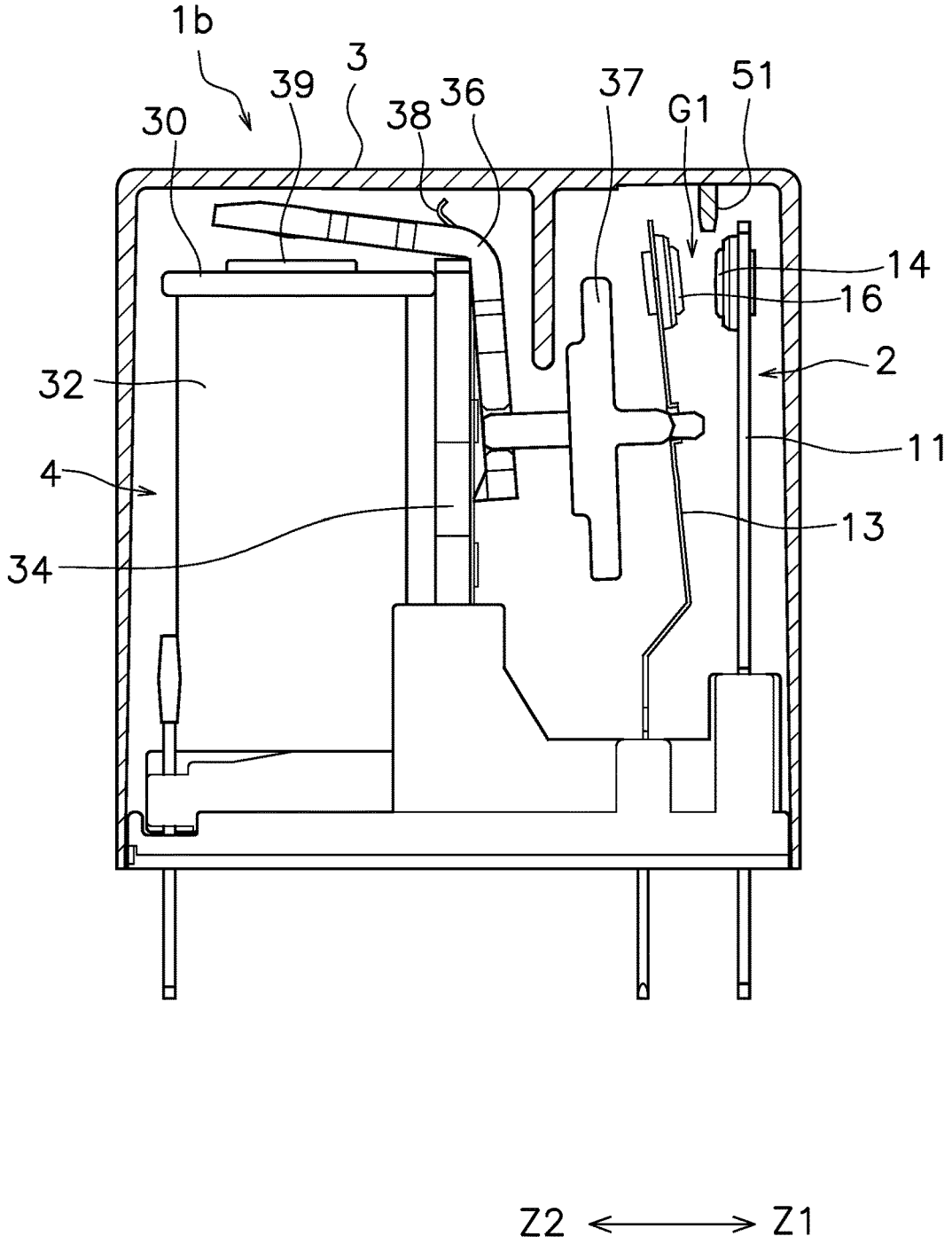
FIG. 6 is a side sectional view of a relay according to another embodiment.

The relay 1*a* described above is a so-called plunger relay, but the present invention may be applied to another type of relay, instead of the plunger relay. For example, as illustrated in FIG. 6, the present invention may be applied to a hinged relay 1*b*. In FIG. 6, the same reference numerals are given to the elements corresponding to those of the above-described embodiment. With the hinged relay 1*b* illustrated in FIG. 6, when the coil 32 is magnetized, an armature 36 is attracted to an iron core 39 by magnetic force of the coil 32, causing the armature 36 to swing. A card 37 is connected to the armature 36. The card 37 presses the movable contact piece 13 in response to the swing of the armature 36, causing the movable contact piece 13 and the movable contact 16 to move toward the contact direction Z1. As a result, the movable contact 16 contacts the fixed contact 14.

When the coil 32 is demagnetized, the armature 36 swings toward the opposite direction by elastic force of a hinge spring 38. As a result, the card 37, the movable contact piece 13, and the movable contact 16 move toward the separation direction Z2, and the movable contact 16 separates from the fixed contact 14. The arc extinguishing member 51 is disposed facing the gap G1 between the movable contact 16 and the fixed contact 14. The arc extinguishing member 51 has a shape that tapers toward the gap G1. Accordingly, the hinged relay 1*b* also achieves the same effect as that of the relay 1*a* according to the above-described embodiment.

The shape or disposition of the first fixed terminal 11, the second fixed terminal 12, or the movable contact piece 13 may be changed. The shape or disposition of the coil 32, the spool 30, or the yoke 34 may be changed. The shape or disposition of the first fixed contact 14, the second fixed contact 15, the first movable contact 16, and the second movable contact 17 may be changed.

The first fixed contact 14 may be provided separately from or integrated with the first fixed terminal 11. The second fixed contact 15 may be provided separately from or integrated with the second fixed terminal 12. The first movable contact 16 may be provided separately from or integrated with the movable contact piece 13. The second movable contact 17 may be provided separately from or integrated with the movable contact piece 13.

The shape and/or disposition of the arc extinguishing member is not limited to that of the above-described embodiment and may be changed. For example, the arc extinguishing member may be connected to the top surface 41, instead of the side surfaces 42 and 43 of the housing 3. Alternatively, the arc extinguishing member may be connected to the partition wall 46. The positional relationship between the arc extinguishing member and the contacts is not limited to the relationship of the distances D1 to D3 described above and may be changed.

Figure 7A:
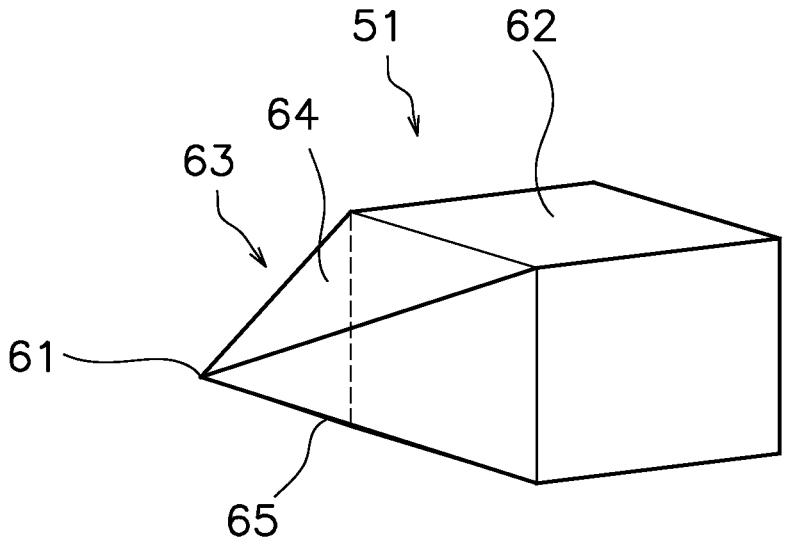
FIG. 7A is a view illustrating arc extinguishing members according to modified examples.
Figure 7B:
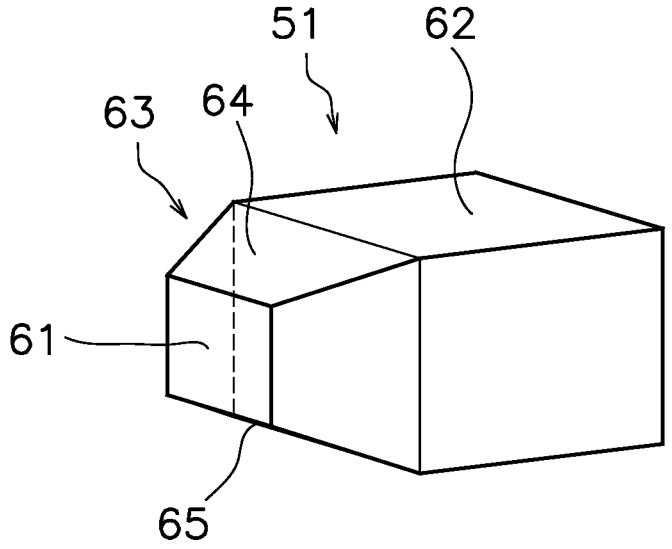
FIG. 7B is a view illustrating arc extinguishing members according to modified examples.
Figure 8A:
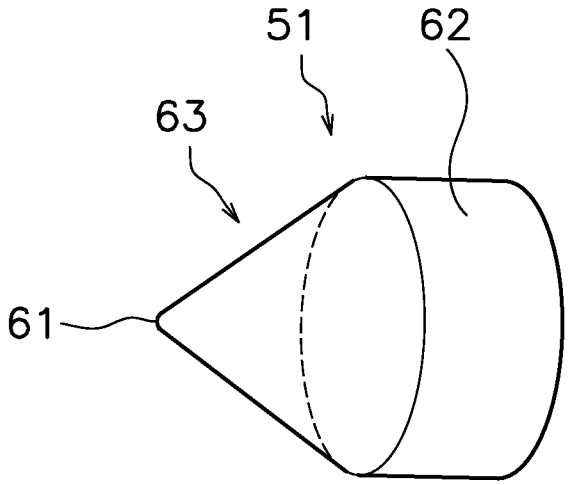
FIG. 8A is a view illustrating arc extinguishing members according to modified examples.
Figure 8B:
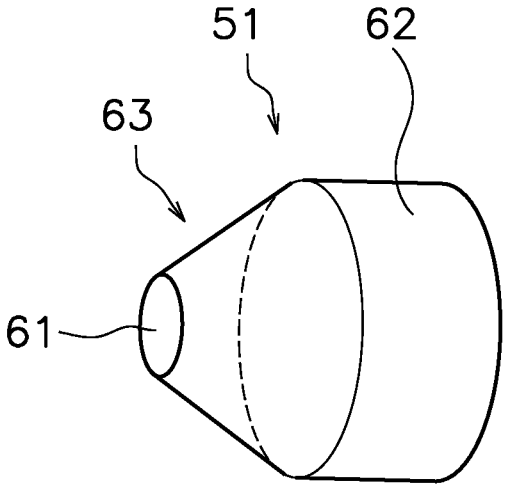
FIG. 8B is view illustrating arc extinguishing members according to modified examples.

As illustrated in FIG. 7A, the arc extinguishing member 51 may have a pyramid shape. As illustrated in FIG. 7B, the arc extinguishing member 51 may have a truncated pyramid shape. As illustrated in FIG. 8A, the arc extinguishing member 51 may have a cone shape. As illustrated in FIG. 8B, the arc extinguishing member 51 may have a truncated cone shape.

Figure 9:
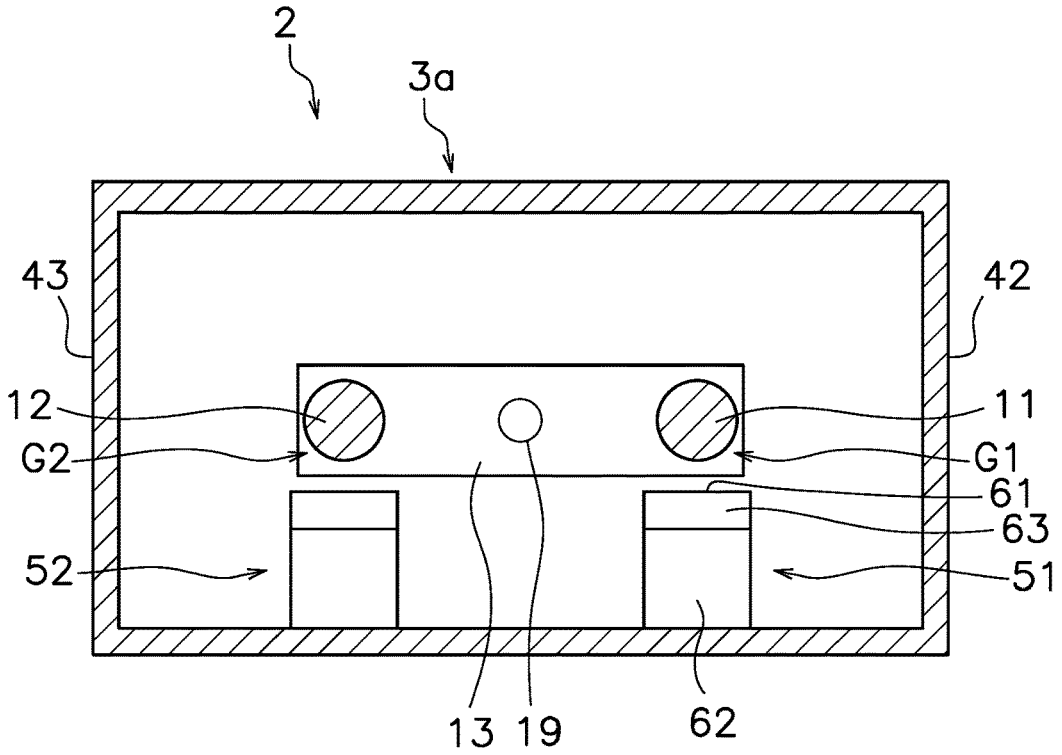
FIG. 9 is a plan view of a contact device according to a first modified example of the embodiment.

In the above-described embodiment, the first arc extinguishing member 51 faces the first gap G1 in the left-right direction. The second arc extinguishing member 52 faces the second gap G2 in the left-right direction. However, the direction in which the arc extinguishing member and the gap face each other is not limited to the left-right direction, that is, not limited to the longitudinal direction of the movable contact piece 13. For example, FIG. 9 is a plan view of the contact device 2 according to a first modified example. As illustrated in FIG. 9, the arc extinguishing members 51 and 52 may face the gaps G1 and G2 in the front-back direction. That is, the arc extinguishing members 51 and 52 may contact the gaps G1 and G2 in the lateral direction of the movable contact piece 13.

Figure 10:
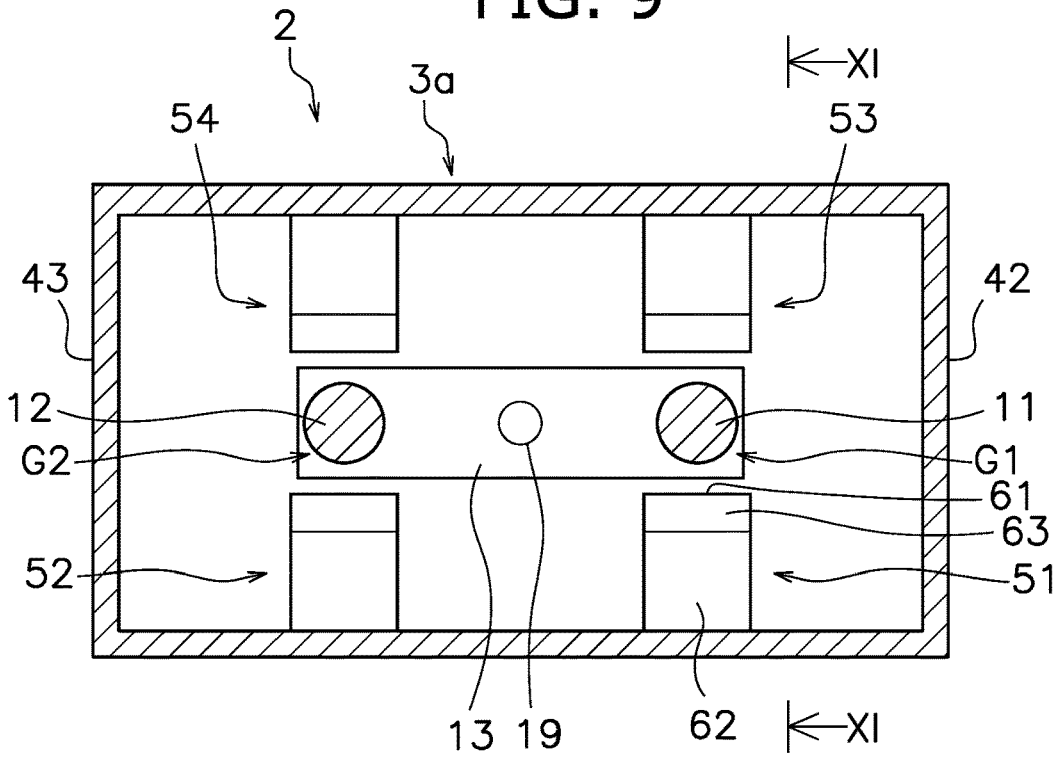
FIG. 10 is a plan view of a contact device according to a second modified example of the embodiment.
Figure 11:
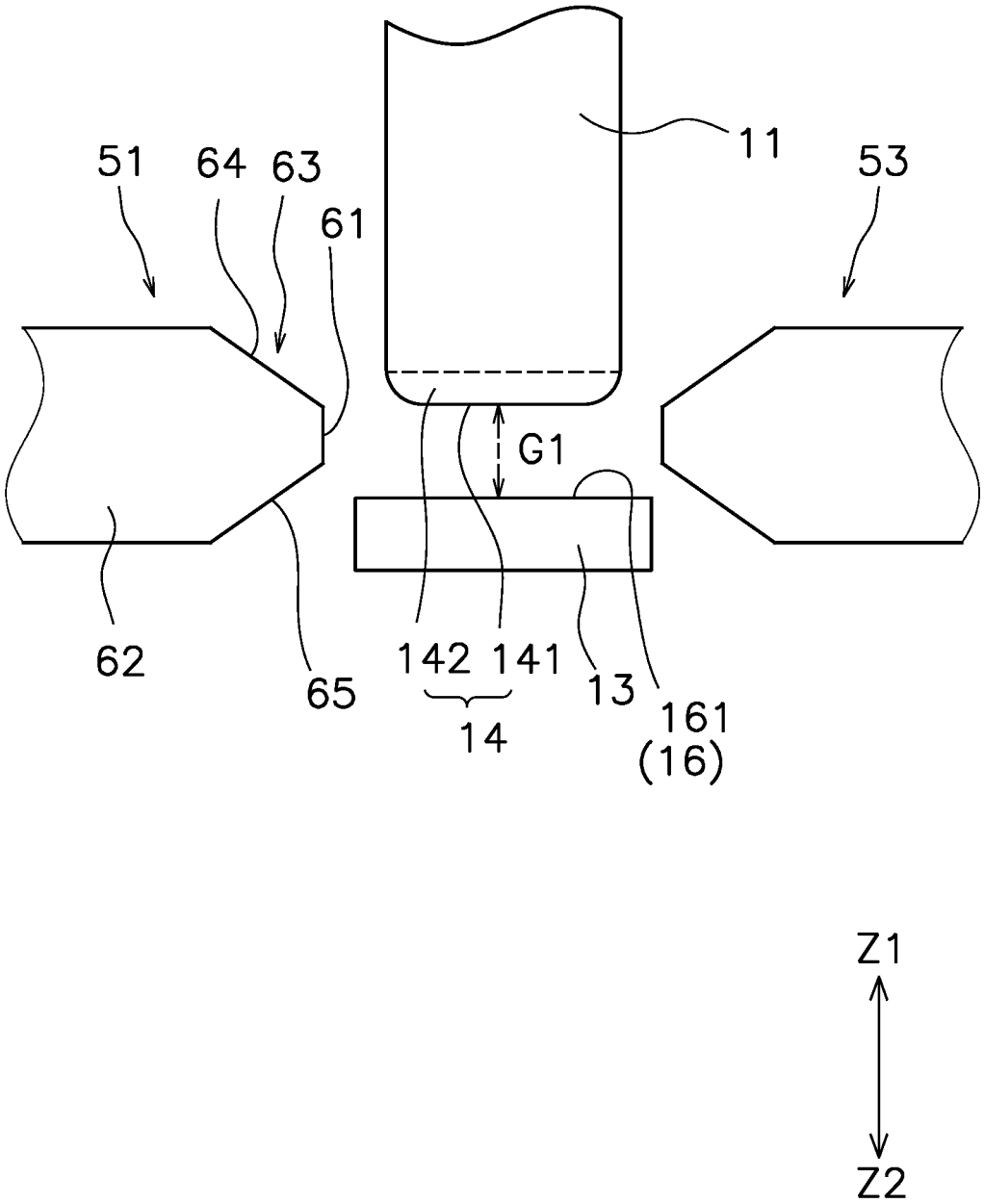
FIG. 11 is a cross-sectional view taken along a line XI-XI of FIG. 10.

In the above-described embodiment, the first arc extinguishing member 51 and the second arc extinguishing member 52 are provided. However, the number of arc extinguishing members is not limited to two and may be less than two or more than two. For example, one of the first arc extinguishing member 51 or the second arc extinguishing member 52 may be omitted. FIG. 10 is a plan view of the contact device 2 according to a second modified example. FIG. 11 is a cross-sectional view taken along a line XI-XI of FIG. 10. As illustrated in FIGS. 10 and 11, two arc extinguishing members 51 and 53 may be disposed facing the first gap G1, with the first gap G1 in between. Two arc extinguishing members 52 and 54 may be disposed facing the second gap G2, with the second gap G2 in between.

REFERENCE NUMERALS

3 Housing
14 Fixed contact
16 Movable contact
51 Arc extinguishing member
61 Tip portion
62 Base portion
63 Tapered portion
141 Contact surface
142 Corner portion
G1 Gap

The invention claimed is:

1. A contact device comprising:
a fixed contact;
a movable contact configured to move between a closed position where the movable contact contacts the fixed contact and an open position where the movable contact is separate from the fixed contact;
a housing configured to house the fixed contact and the movable contact; and
an arc extinguishing member disposed in the housing, the arc extinguishing member being configured to discharge an arc extinguishing gas, the arc extinguishing member being disposed facing a gap between the fixed contact and the movable contact in a state where the movable contact is in the open position, the arc extinguishing member having a shape that tapers toward the gap,
the arc extinguishing member including
a tip portion facing the gap,
a base portion having a larger outer shape than the tip portion, and
a tapered portion provided between the tip portion and the base portion, the tapered portion having a shape that tapers from the base portion toward the tip portion, the tapered portion including a first tapered portion and a second tapered portion, the first tapered portion facing the fixed contact in a direction in which the arc extinguishing member faces the gap, the second tapered portion facing the movable contact in the direction in which the arc extinguishing member faces the gap.

2. The contact device according to claim 1, wherein
a direction from the movable contact toward the fixed contact is defined as an upper direction and an opposite direction thereto is defined as a lower direction, and
an upper end of the base portion is positioned above a lower end of the fixed contact.

3. The contact device according to claim 2, wherein an upper end of the tip portion is positioned below the upper end of the base portion.

4. The contact device according to claim 2, wherein a lower end of the base portion is positioned below an upper end of the movable contact.

5. The contact device according to claim 4, wherein a lower end of the tip portion is positioned above the lower end of the base portion.

6. The contact device according to claim 1, wherein a direction from the movable contact toward the fixed contact is defined as an upper direction and an opposite direction thereto is defined as a lower direction, and the fixed contact includes a contact surface configured to contact the movable contact in a state where the movable contact is in the closed position, and a corner portion positioned above the contact surface, connected to the contact surface, and having a curved shape or a chamfered shape, and an upper end of the tip portion is positioned below an upper end of the corner portion.

7. The contact device according to claim 6, wherein the tip portion is positioned between the upper end of the corner portion and an upper end of the movable contact in the upper and lower directions.

8. The contact device according to claim 1, wherein in a direction from the arc extinguishing member toward the gap, a distance between a tip of the arc extinguishing member and the fixed contact is smaller than a distance from the housing to the tip of the arc extinguishing member.

9. The contact device according to claim 1, wherein in a direction from the arc extinguishing member toward the gap, a distance between a tip of the arc extinguishing member and the movable contact is smaller than a distance from the housing to the tip of the arc extinguishing member.

* * * * *